US007513642B2

(12) United States Patent
Sormani

(10) Patent No.: US 7,513,642 B2
(45) Date of Patent: Apr. 7, 2009

(54) LED COLLIMATOR ELEMENT WITH A SEMIPARABOLIC REFLECTOR

(75) Inventor: Joseph Sormani, Knegsel (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 27 days.

(21) Appl. No.: 11/575,330

(22) PCT Filed: Sep. 12, 2005

(86) PCT No.: PCT/IB2005/052976

§ 371 (c)(1),
(2), (4) Date: Mar. 15, 2007

(87) PCT Pub. No.: WO2006/033040

PCT Pub. Date: Mar. 30, 2006

(65) Prior Publication Data

US 2007/0211487 A1 Sep. 13, 2007

(30) Foreign Application Priority Data

Sep. 20, 2004 (EP) ..... 04104537

(51) Int. Cl.
*F21V 5/00* (2006.01)

(52) U.S. Cl. ..... 362/245; 362/307; 362/327; 362/545; 362/800

(58) Field of Classification Search ..... 362/241, 362/245, 307, 311, 326, 327, 247, 545, 800; 257/98

See application file for complete search history.

(56) References Cited

U.S. PATENT DOCUMENTS

| | | | | |
|---|---|---|---|---|
| 5,434,754 | A | 7/1995 | Li et al. | |
| 6,335,548 | B1 * | 1/2002 | Roberts et al. | 257/98 |
| 6,398,988 | B1 | 6/2002 | Jenkins et al. | |
| 6,945,672 | B2 * | 9/2005 | Du et al. | 362/241 |
| 2003/0198060 | A1 | 10/2003 | Ishida et al. | |
| 2003/0214815 | A1 | 11/2003 | Ishida et al. | |
| 2004/0042212 | A1 | 3/2004 | Du et al. | |
| 2004/0076016 | A1 | 4/2004 | Sato et al. | |

FOREIGN PATENT DOCUMENTS

| | | |
|---|---|---|
| DE | 10140692 | 3/2003 |
| GB | 521268 | 11/1938 |
| JP | 05109301 | 10/1991 |
| JP | 10284757 | 4/1997 |

* cited by examiner

*Primary Examiner*—Stephen F Husar

(57) ABSTRACT

The invention relates to an LED lighting device, in particular for motor vehicle headlamps, which comprises an LED element (3), a collimator (1) which emits the light emitted by the LED element (3) through a collimator opening (5) in a collimated manner, and a reflector (7) which has a semiparabolic concave reflective surface (8), an irradiated plane (9), a focal point (F) in the irradiated face (9) and an emission plane (10) which emits light in an emission direction of the reflector (7) and encloses an angle with the irradiated face (9). According to the invention, the collimator (1) is designed and/or arranged in such a way that the collimated light coming from the collimator (1), as seen in the emission direction, is irradiated into the irradiated face (9) either completely in front of or completely behind the focal point (F).

10 Claims, 4 Drawing Sheets

LED COLLIMATOR ELEMENT WITH A SEMIPARABOLIC REFLECTOR

The invention relates to an LED lighting device, in particular for motor vehicle headlamps, in which the light emitted by an LED element is almost entirely deflected by a semiparabolic reflector.

The development of LED elements means that, in the near future, LED elements will be available which have sufficient brightness to be used for example as front headlamps of motor vehicles. With vehicle headlamps, there are generally produced firstly a so-called main beam and secondly a low beam. The main beam provides a maximum possible illumination of the traffic space. The low beam, on the other hand, provides a compromise between as good an illumination as possible from the perspective of the vehicle driver and as little dazzling of oncoming vehicles as possible. To this end, a lighting pattern has been developed in which no light is irradiated into an emission plane of the headlamp above a horizontal line. The headlamp must therefore form a sharp cut-off in order that the oncoming traffic is not dazzled under normal conditions on a straight road. However, since the headlamp with the region directly below the cut-off is to illuminate that traffic space which has the greatest distance from the vehicle, on the other hand the greatest intensity of the headlamp must be provided directly at the cut-off.

Particularly for use as motor vehicle headlamps, therefore, two essential properties of a lighting device are required: firstly, the light source must be able to illuminate with a high intensity a space at a distance of approximately 75 m from the light source, and secondly it must form a sharp cut-off between the well-illuminated space and the non-illuminated area lying behind it. A sufficient intensity in the well-illuminated area is directly related to the brightness (luminance) of the LED element and the performance of the optics which cooperate therewith. On the other hand, a sharp cut-off is a design requirement.

In the halogen and xenon lamp systems used to date, a sharp cut-off is usually achieved by screens being used. Together with reflectors and projection lenses, a sharp cut-off can thus be achieved. Although the use of screens entails a loss of light, since it is absorbed or reflected at the screen, this is not a problem at least in xenon lamp systems since they produce sufficient light current.

In lamp systems using LEDs, attempts are being made to overcome the problem of intensity, including by using a number of LEDs, by superposing their lighting images, and by as much as possible of the light emitted by the LED being intercepted and deflected in a more or less parallel manner into the emission direction of the lighting device. Such an arrangement is known for example from US 2004/0042212 A1. According to said document, an LED is placed on a support substrate. The support substrate and with it the LED are curved over by a parabolic reflector which meets the support substrate on one side and on the other side forms a light emission face by being spaced apart from the support substrates The LED on the support substrate is accordingly thus located in a space between the support substrate and the parabolic reflector. It is arranged in such a way that the light radiation coming therefrom is almost completely reflected at the reflector and most of it is emitted as parallel radiation via the light emission face. By arranging the LED between the focal point of the parabolic reflector and that edge of the reflector which meets the support substrate, a sharp cut-off can be achieved in this arrangement.

It is an object of the present invention to improve the effectiveness of the abovementioned LED lighting device for producing a sharp cut-off.

In order to achieve this object, there is proposed an LED lighting device, in particular for use in motor vehicle headlamps, which comprises an LED element, the light of which is emitted in a mainly indirect manner on account of reflection. Said LED lighting device also comprises a collimator which emits the light emitted by the LED element through a collimator opening in a collimated manner, and also a reflector which has a semiparabolic concave reflective surface, an irradiated face, a focal point in the irradiated face and an emission face from which light is emitted in an emission direction of the reflector and which encloses an angle with the irradiated face. The collimator is designed and/or arranged in such a way that the collimated light coming from the collimator, as seen in the emission direction, is irradiated into the irradiated face either completely in front of or completely behind the focal point.

Unlike a reflector, a collimator is to be understood as meaning a reflective face which essentially intercepts all of the light of the LED element which is not emitted in the emission direction. The collimator is therefore located directly adjacent to the LED chip. In order to take account of tolerances during manufacture of the LED chip, the collimator may be at a short distance of approx. 0.5 mm from the LED. However, the distance is preferably even less than 0.5 mm, particularly preferably below approx. 0.25 mm.

The emission direction of an LED element is understood to mean the vertical with respect to the plane in which the chip of the LED element is arranged.

The focal point of the reflector is the focus thereof. Light which is irradiated in at said focus point is always emitted in the same direction by the reflector, namely the emission direction, regardless of the direction from which it arrives on the reflector from the focal point, that is to say all the light rays irradiated into the reflector at the focal point in the irradiated face are emitted from the emission face in a parallel manner.

The focal point is located in the irradiated face of the reflector at which light radiation is coupled into the reflector. The edges of the irradiated face are essentially determined by the geometry of the reflector. Reflector and irradiated face meet at a rear edge in the emission direction.

At a front edge in the emission direction, the irradiated face meets the emission face. It usually coincides with an opening face of the reflector and generally runs at right angles to the irradiated face and to the emission direction of the reflector.

Hereinbelow, it is assumed that the LED elements are inorganic solid state LEDs since these are currently available with sufficient intensity. Nevertheless, they may of course also be other electroluminescent elements, for example laser diodes, other light-emitting semiconductor elements or organic LEDs, provided these have sufficient power. The term "LED" or "LED element" is therefore to be regarded in this document as a synonym for any type of appropriate electroluminescent element.

The invention thus moves away from a design in which a semiparabolic reflector deflects the radiation coming in a non-directional manner from an LED element as far as possible in a desired direction. Rather, the invention follows the principle firstly of collimating the radiation emitted in a non-directional manner (Lambert's radiation) of an LED element and then introducing the thus aligned radiation into a semiparabolic reflector in a targeted manner in order to deflect it completely in a desired direction. To this end, it provides a collimator which collimates the light of one or more LED elements and irradiates it in a substantially bundled manner at its opening face into a reflector. This means firstly that the reflector can be much smaller since it can be designed in a targeted manner for the radiation emitted by the collimator and does not have to "catch" any scattered radiation. Secondly, the arrangement of the collimator can ensure that almost all of the light power of the LED element(s) is intercepted.

The geometry of the semiparabolic reflector is used to reliably produce a sharp cut-off. To this end, it is important to irradiate the light radiation completely in front of or completely behind the focal point of the reflector, possibly including the focal point, when seen in the emission direction. The focal point therefore marks a boundary which may however also be included in the irradiation of the light. The wording "in front of" or "behind the focal point" is therefore intended, unless specified otherwise, also to include the case where the focal point itself lies within the irradiated area. If the light is therefore not completely irradiated in on that side of the boundary defined by the focal point, the cut-off will be "diluted". The term "completely" is understood to mean that no light is to be irradiated into the irradiated plane behind and in the focal point if the collimator opening is arranged in front of the focal point, and vice versa. It is not impossible for the collimator opening to project beyond the irradiated face, even if light radiation is lost as a result.

In the above consideration, assumed as a basis is a three-dimensionally curved semiparabolic reflector into which an almost punctiform radiation is irradiated from an LED collimator unit. In order to provide linear light radiation, to date a number of semiparabolic reflectors have been arranged next to one another. According to one advantageous embodiment of the invention, by contrast, the semiparabolic reflector is curved only in a two-dimensional manner and accordingly has a focal line. The two-dimensionally curved semiparabolic reflector has, in a sectional view parallel to the emission direction of the reflector, in principle the same geometric design as a three-dimensionally curved reflector in a section in the emission direction and through the focal point. However, since the two-dimensionally curved reflector has the same unmodified design in a direction orthogonal to the sectional plane, a focal line is produced by arranging the focal points of each sectional view next to one another in rows. However, in a sectional plane, the focal line has the same geometric significance as the focal point of a three-dimensionally curved reflector, and for this reason no distinction is made below between focal point and focal line and only the respective sectional planes of the reflectors will be considered.

According to one advantageous embodiment of the invention, the collimator opening is arranged between the focal point and an edge of the irradiated plane. This means that at least one internal dimension, for example a diameter of the collimator opening, is smaller than the distance between the focal point and the edge of the irradiated plane. This arrangement ensures that no light power of the LED element is lost upon leaving the collimator opening when light is coupled into the reflector.

This purpose can also be achieved by the shape of the collimator opening. According to further advantageous embodiments of the invention, the collimator opening is round or as an alternative is rectangular, in particular square. In order to make optimal use of the irradiated face and to prevent losses, the collimator opening can thus be adapted to the contour of the irradiated face. In the case of a two-dimensionally curved reflector with a square or rectangular irradiated face for example, the collimator opening may likewise be square or rectangular.

For use as a motor vehicle headlamp, for example, the LED lighting device must have, besides a sharp cut-off and sufficient brightness, also a gradient in terms of brightness distribution. A particularly high brightness should be produced directly at the cut-off. A further advantageous embodiment of the invention provides that the unit consisting of LED element and collimator is designed in an asymmetrical manner, in order to produce this gradient. The asymmetry in the unit consisting of LED element and collimator may consist on the one hand in an asymmetrical collimator or on the other hand in a tilted arrangement of the LED element with respect to a symmetrical collimator. In both cases, one collimator inner side is irradiated to a greater extent than the opposite inner side, as a result of which a high brightness is achieved at a first edge of the collimator opening, said brightness decreasing in the direction of an opposite second edge. In this way, a brightness gradient is produced even at the collimator opening.

The asymmetrical LED collimator element is preferably arranged in such a way that it irradiates the light completely in front of or behind the focal point, including the focal point. In one particularly preferred embodiment of the invention, the LED collimator element is arranged with its first edge in the region of the focal point, so that it radiates the light highly bundled at the first edge onto the focal point of the semiparabolic reflector. The formation of a sharp cut-off is thus assisted in design terms in two ways, namely, on the one hand, as described above, by the asymmetrical design of the LED collimator element. On the other hand, the semiparabolic mirror also serves this purpose: by radiating light either in front of or behind the focal point of the semiparabolic reflector, it is ensured that the light is emitted from the semiparabolic reflector only in a region which is sharply delimited on one side by the emission direction of the semiparabolic reflector. The invention consequently makes use of the two effects mentioned above in order to produce a sharp cut-off.

By combining the asymmetrical collimator with a semiparabolic reflector, undesirable scattered light of the asymmetrical collimator, which would dilute the sharp cut-off, is moreover eliminated. This is because the fact of irradiating into the parabolic reflector between the focal point and the first edge of the semiparabolic reflector means that the light, regardless of which direction it is irradiated into the parabolic reflector, in any case cannot be emitted in the undesirable region on the other side of the emission direction of the semiparabolic reflector. By combining asymmetrical LED collimator element and semiparabolic reflector, consequently there is achieved on the one hand a sharp cut-off and on the other hand a high light intensity along the sharp cut-off.

On account of the need to precisely manufacture the reflector in a semiparabolic shape, the cost thereof is considerable. A further advantageous embodiment of the invention therefore provides that a number of LED elements with collimators are arranged next to one another in a direction transverse to the emission direction and jointly irradiate into the reflector. A two-dimensionally curved reflector is particularly suitable for an arrangement of almost any desired number of LED collimator elements next to one another. Compared to a conventional arrangement with a number of reflectors next to one another, the arrangement described above makes it possible to achieve a higher light power with respect to the width of such a lighting device.

As already mentioned above, the manufacture of the collimators for each LED element may also require high precision and a considerable expense. It is therefore advantageous if one collimator or a number of collimators are each assigned a group of LED elements. As a result, the light power of each individual collimator can be considerably increased.

The invention will be further described with reference to examples of embodiments shown in the drawings to which, however, the invention is not restricted.

Figure 1:
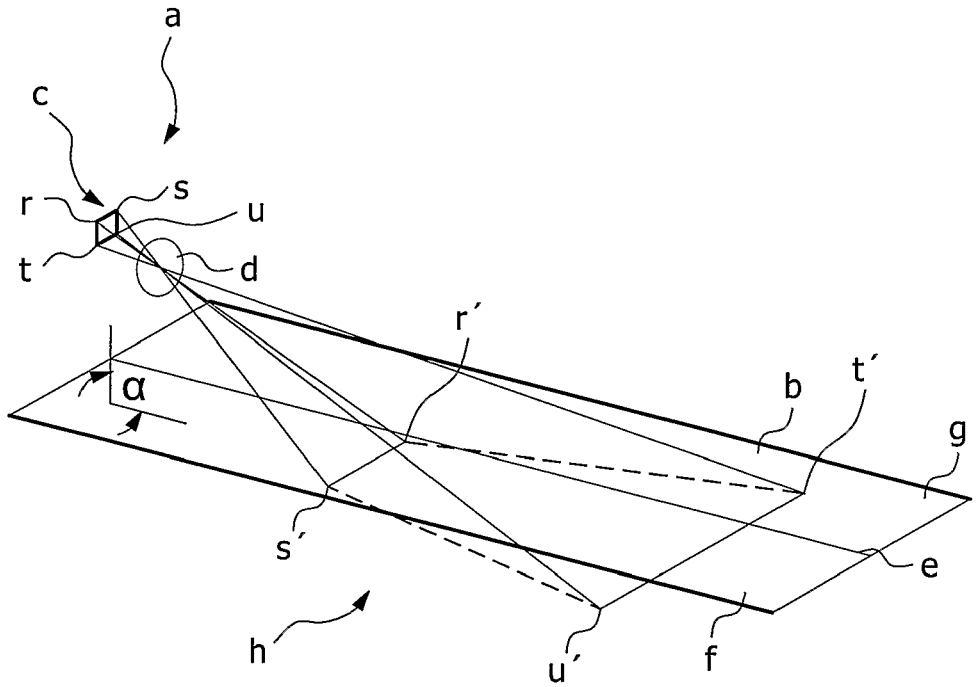
FIG. 1 shows a simplified perspective diagram of the ray courses of a headlamp on a road.

FIG. 1 schematically shows the radiation course of the light of a headlamp a on a road b. The headlamp a is symbolized by an emission face c of an LED collimator element and by secondary optics d. The emission face c has four boundary lines between the corners r, s, t and u. The road b is divided into two lanes f and g by a center line e. A vehicle (not shown) comprising the headlamp a is located in the lane f. The lane g is used for oncoming traffic. The headlamp a illuminates a traffic space h and produces an image there which has the corners r', s', t' and u'.

The light coming from the emission face c strikes the secondary optics d. The latter is usually formed by a lens which projects the image which impinges thereon in a back-to-front and upside-down manner. Since the emission plane c is at an angle a with respect to the lane f which is to be illuminated, the image thereof which is produced on the lane is distorted. Despite an equal length of the dimension from r to s and from t to u, the dimension from t' to u' is a multiple length of the dimension from r' to s'. This distortion also has to be taken into account when illuminating the traffic space h, It means that, given a more or less uniform illumination of the traffic space h, much more light power is required at the edge of the emission plane between u and t than at the opposite edge between r and s. Ideally, therefore, a continuous transition or a light intensity gradient is formed between a high light power at the edge u and t towards a lower light power at the edge r and s.

Figure 2:
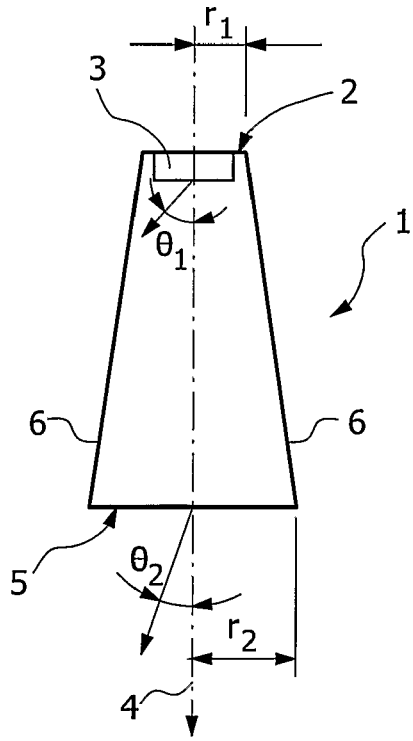
FIG. 2 shows a section through a collimator.

In order to avoid dazzling the oncoming traffic, no light is to be emitted outside the image having the corners r', s', t' and u'. This relates in particular to the edge between t' and u'. Here, the light source must form a sharp cut-off because this edge is most likely to dazzle the oncoming traffic. The cut-off must accordingly be formed at the emission plane along the line from t to u. These requirements are implemented as follows in the design of an LED collimator element according to the invention:

Because LED elements produce light radiation in a semi-spherical and non-directional manner (Lambert's radiation), collimators are used to bundle the light. Such a collimator 1 is shown in FIG. 2. Arranged on the base 2 thereof is an LED element 3 which emits light in a main emission direction 4 through a collimator opening face 5. The base 2 of the collimator has a circular cross section with a radius $r_1$, and the collimator opening 5 which is likewise circular has the radius $r_2$. The collimator has the shape of a truncated c one, the bottom face of which forms the collimator opening 5 and the top face of which forms the base 2. The lateral face 6 of the collimator 1 is inclined at an angle θ with respect to the axis of rotation of the truncated cone, which coincides with the main emission direction 4. With an angle $\theta_1$ as the emission angle of the LED 3 with respect to the main emission direction 4, with an angle $\theta_2$ as the emission angle of the light at the collimator opening 5 with respect to the main emission direction 4, with $n_1$ as the refractive index in the collimator 1 and with $n_2$ for the refractive index outside the collimator 1 in front of the collimator opening 5, the following equation is generally obtained as the ratio between a first emission situation directly at the LED element 3 and a second emission situation at the collimator opening 5 of the collimator 1:

$$n_1 \times r_1 \times \sin\theta_1 = n_2 \times r_2 \times \sin\theta_2 \tag{1}$$

If the materials in the collimator 1 and in front of the collimator 1 are the same (e.g. air), then $n_1 = n_2$. In this special case:

$$\sin\theta_2 = \frac{r_1}{r_2} \times \sin\theta_1 \tag{1a}$$

It is clear that, when ignoring losses caused by reflection of the light radiation at the collimator opening 5, much more favorable emission ratios are obtained. This is because all of the light radiation emitted from the LED 3 can then be used in a highly bundled manner at a smaller emission angle at the collimator opening 5.

Figure 3:
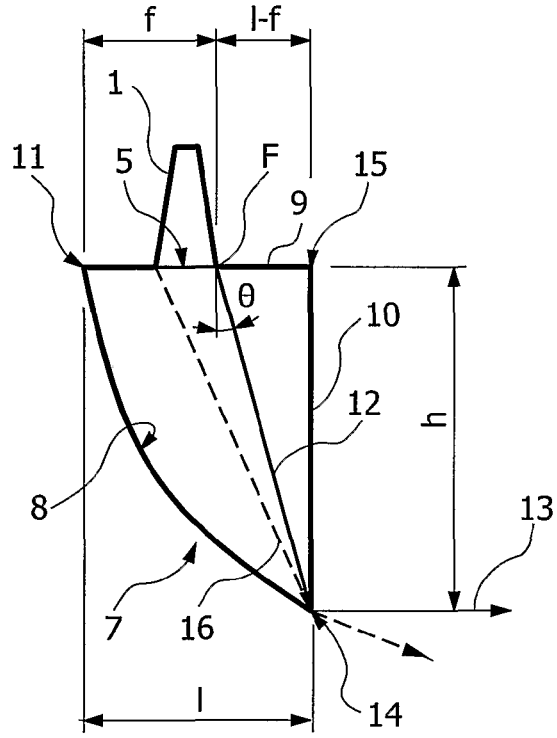
FIG. 3 shows a section through a lighting device comprising a collimator and a reflector.

The invention makes use of this by irradiating the thus bundled radiation at the collimator opening 5 directly into a semiparabolic reflector 7 as shown in FIG. 3. The reflector 7 comprises a semiparabolic concave reflective surface 8, an irradiated face 9 and an emission face 10. The irradiated face 9 adjoins the reflector 7 at a first edge 11 and contains a focal point F. Light radiation which is irradiated into the reflector at this point via the irradiated face 9 and is reflected on the reflective surface 8 thereof is emitted out of the reflector again at right angles to the emission face 10, regardless of the angle at which it entered the reflector 7 at the focal point F. This ray path is shown by way of example by the arrows 12 and 13. The emission face 10 extends from a lower edge 14 of the reflector 7 to an imaginary edge 15 at which it meets the irradiated face 9 at right angles.

The reflector 7 has a length l and a height h, wherein l corresponds to the size of the entry face 9 and h corresponds to the size of the emission face 10. The distance of the focal point F from the first edge 11 is designated f, and the distance between the focal point F and the edge 15 is accordingly l−f.

The collimator 1 is arranged with its collimator opening 5 between the focal point F and the first edge 11. In an extreme case, an internal dimension of the collimator opening 5 could assume the length of the distance f. For a given collimator, the following equation then applies for the design of the reflector:

$$f \leqq 2 \times r_2 \tag{2}$$

According to this equation, the reflector 7 can be dimensioned such that on the one hand all of the light emitted from the collimator opening 5 is caught and deflected and on the other hand the reflector 7 is not made unnecessarily large. Depending on the emission angle θ of the collimator 1, the following associations are therefore obtained: the length l of the reflector 7 is determined by a light ray which enters the reflector 7 at the outermost edge of the collimator opening 5 and at the focal point F. The length l does not need to be any greater because the reflector 7 does not catch any more light as a result. On the other hand, it cannot be any smaller since this would lead to losses in terms of emitted radiation. With the length l and the distance f between the focal point F and the first edge 11, the height of the reflector 7 becomes:

$$h = 2 \times \sqrt{l \times f} \tag{3}$$

According to the rules of trigonometry, the following is therefore obtained for the angle θ:

$$\tan\theta = \frac{1-f}{2\times\sqrt{1\times f}} \quad (4)$$

This gives rise to the following:

$$i=2\times f\times(l+2\times\tan\theta^2)+2\times f\times\tan\theta\times\sqrt{l+\tan\theta^2} \quad (5$$

This equation can be used to determine the geometry of the reflector 7 as a function of the angle θ.

Figure 4:
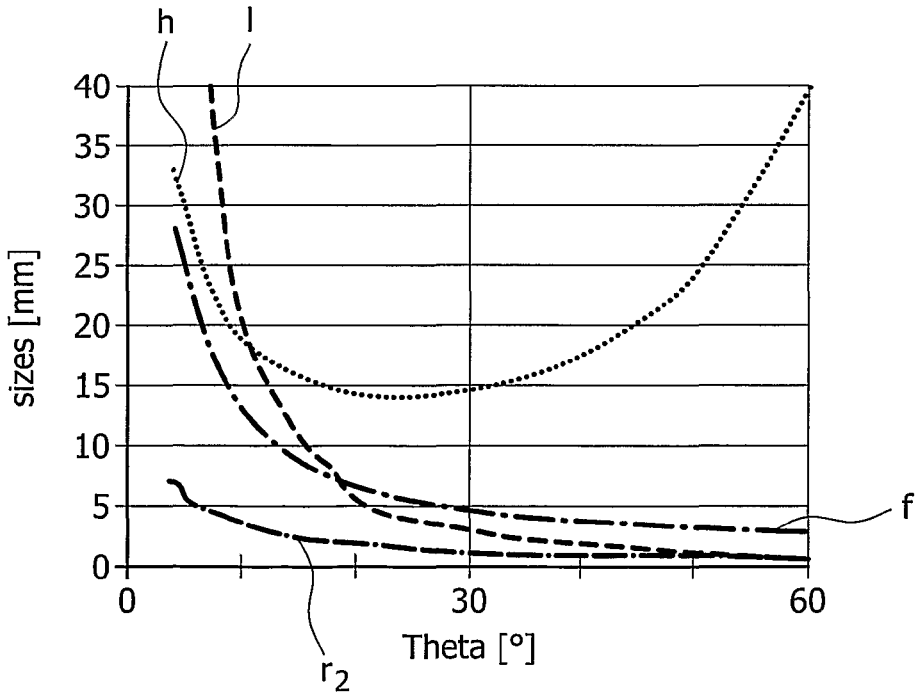
FIG. 4 shows a graph for configuring a reflector in dependence on an opening angle of the collimator.

FIG. 4 shows a graph in which the values for $r_2$, l, f and h are given as a function of the angle θ. The assumed basis is a fixed value for $r_1$ of 0.5 mm. The value of $r_1$ is selected such that the collimator 1 can be placed on an LED element 3 with a diameter of 1 mm, ignoring any tolerances. The graph shows that there is an angle θ for which the height h of the reflector 7 assumes a minimum value. If the dimensions h and l are not subject to any other restrictions, an optimal value is consequently obtained for the angle θ at which the reflector 7 has the smallest possible dimensions.

FIG. 3 moreover shows the formation of a sharp cut-off at the emission face 10. Only that radiation which is coupled into the irradiated plane 9 precisely at the focal point F, such as the ray 12 for example, leaves the reflector 7 in a horizontal emission direction, such as the ray 13 for example. Any radiation which is irradiated in at the focal point F is deflected into this emission direction in the reflector 7. By contrast, radiation which passes into the reflector 7 between the focal point F and the first edge 11 has a direction, when it leaves the reflector 7, which is inclined downwards at an angle with respect to the direction of the arrow 13. No light is emitted above the horizontal emission direction of the arrow 13 since no light is introduced in front of the focal point F. The ray 13 thus marks the cut-off of the reflector 7. Since, furthermore, the maximum light intensity e.g. of a vehicle headlamp is to be achieved at the cut-off, it should therefore be ensured that as much light as possible is introduced at or close to the focal point F. This may advantageously be achieved in that, instead of the symmetrical unit consisting of collimator 1 and LED element 3 as shown in FIGS. 1 and 2, an asymmetrical unit is used, the light intensity gradient of which has a maximum at the focal point F (cf. FIGS. 5 and 6).

FIG. 3 shows a section through an LED lighting device according to the invention which comprises just one LED 3, a collimator 1 and a reflector 7. Of course, a number of such units may be arranged next to one another, that is to say perpendicular to the plane of the drawing in FIG. 3. There is advantageously an arrangement of a number of units consisting of collimators and LED elements, which irradiate jointly into one reflector 7.

Figure 5:
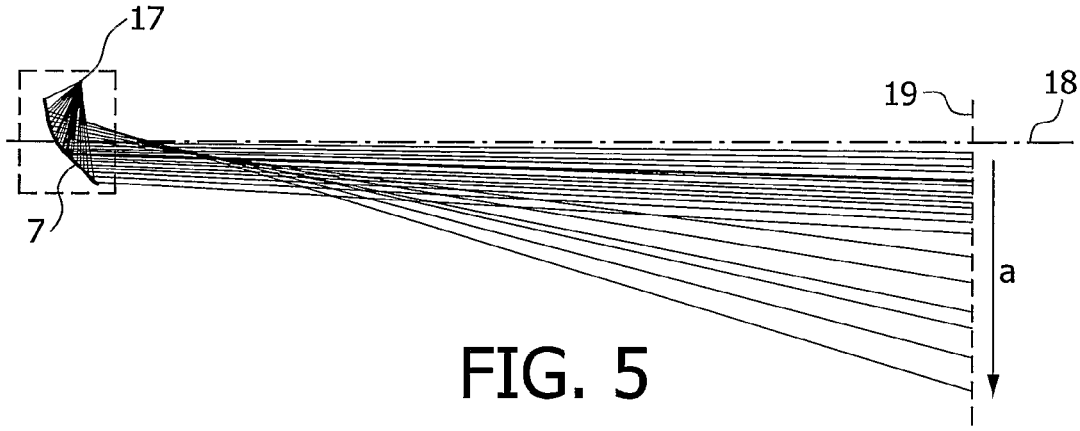
FIG. 5 shows an overall view of an LED collimator element in conjunction with a parabolic reflector and the associated radiation course.
Figure 6:
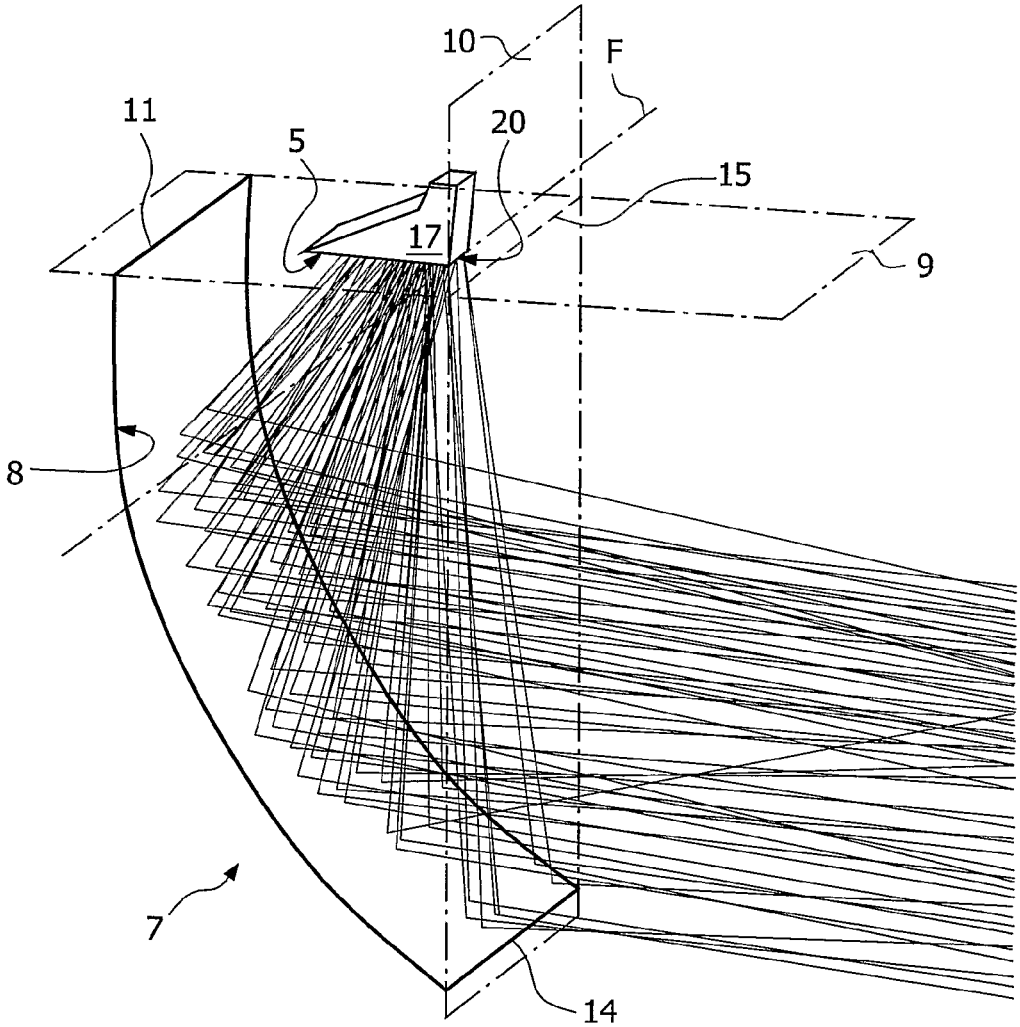
FIG. 6 shows a detailed view of part of the diagram of FIG. 5.

Such an arrangement is suitable in particular for arranging on a two-dimensionally curved semiparabolic reflector 7, as shown in FIGS. 5 and 6. In order to illustrate the cooperation of the semiparabolic reflector 7 with an asymmetrical LED collimator element 17, for the sake of clarity just one LED collimator element 17 on the reflector 7 is shown here. With the exception of the choice of an asymmetrical LED collimator element 17, the perspective view of FIG. 5 corresponds to the sectional view of FIG. 2. Identical parts therefore bear the same reference numbers.

The arrangement of asymmetrical LED collimator element 17 and reflector relative to one another as shown in FIG. 5 has the effect that all of the light coming from the LED collimator element 17 and deflected by the reflector 7 is emitted below a cut-off plane 18 which runs parallel to the emission direction of the reflector 7. Since light is introduced exclusively between the focal line F and the rear edge 11 of the reflector 7, no radiation is emitted above the cut-off plane 18. A sharp cut-off is thus formed on a desired image face 19, which is selected for example to be at right angles to the emission direction, at the intersection between said image face and the cut-off plane 18. Moreover, the above-described lighting gradient which exists at the emission face 10 of the LED collimator element 17 is likewise transmitted into the image face 19, so that there is a decreasing lighting intensity in the direction of the arrow a.

FIG. 6 shows a detail of FIG. 5. The asymmetrical LED collimator element 17 is arranged with its emission face 10 in an irradiated plane 9 of the semiparabolic reflector 7 in such a way that it extends from a focal line F in the direction towards a rear edge 11 of the semiparabolic reflector 7. The LED collimator element 17 is moreover oriented in such a way that its front edge 20, at which there is maximum light radiation, coincides with the focal line F.

Figure 7:
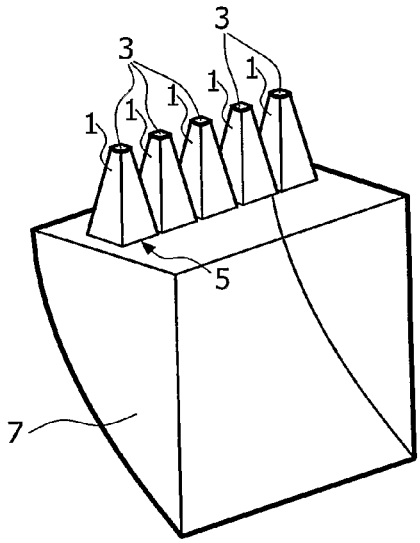
FIG. 7 shows an embodiment with a number of collimators.

FIG. 7 shows an example of an embodiment comprising an arrangement of a number of collimators. Accordingly, five units consisting of LED elements 3 and collimators 1 which are arranged next to one another jointly irradiate into a two-dimensionally curved semiparabolic reflector 7. In order to make optimal use of the irradiated face of the reflector 7, the collimators 1 in each case have a square collimator opening 5, so that they can be arranged next to one another in a space-saving manner. In principle, however, other collimators, e.g. round collimators, could also be arranged next to one another in this way.

Figure 8A:
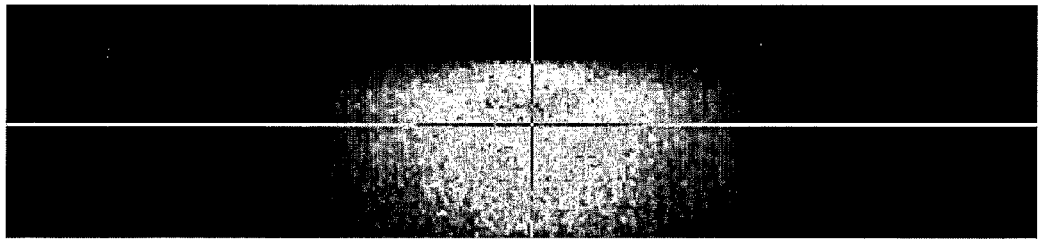
FIG. 8 shows lighting images of two different lighting devices.
Figure 8B:
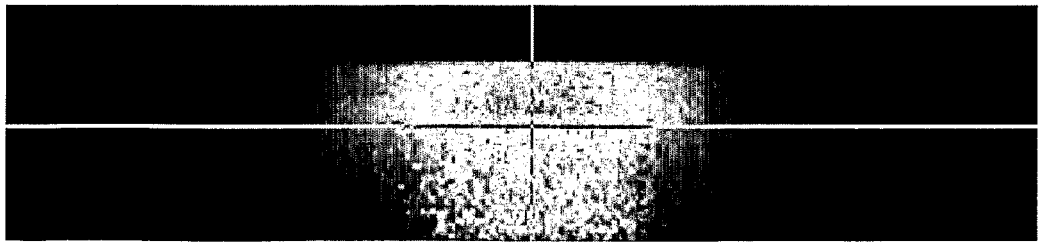

FIGS. 8*a* and 8*b* show the difference between a round collimator opening and a square collimator opening. They show lighting images which are in each case produced by an LED collimator element using both outline shapes of the collimator opening. A round collimator opening was used for the diagram in FIG. 8*a*, whereas a square collimator opening was used for the lighting image of FIG. 8*b*. When using a square collimator opening, a clear cut-off is formed even in the case of just one LED collimator element, as shown in FIG. 8*b*. In FIG. 8*a*, on the other hand, only the beginnings of a cut-off can be seen.

Finally, it should once again be pointed out that the systems and methods shown in the figures and the description are merely examples of embodiments which can be widely varied by the person skilled in the art without departing from the scope of the invention.

Moreover, for the sake of clarity, it should be pointed out that the use of the indefinite article "a" or "an" does not prevent it from being possible for the relevant features to be present more than once.

The invention claimed is:

1. An LED lighting device comprising:

an LED element configured to emit light;

a collimator including a truncated collimator element having a top face forming a base with a first cross-section, a bottom face forming a collimator opening with a second cross-section, wherein the second cross-section is larger than the first cross-section, and a lateral face disposed between the top face and the bottom face at an angle with respect to an axis of the collimator, the collimator configured to collimate the light emitted by the LED element and irradiate the collimated light through the collimator opening in a collimated manner; and a reflector which has (i) a semiparabolic concave reflective surface, (ii) an irradiated face, (iii) a focal point (F) in the irradiated face and (iv) an emission face from which light is emitted in an emission direction of the reflector during operation and which encloses an angle with the irradiated face, wherein the collimator is further configured to enable the collimated light coming from the collimator through the collimator opening, as seen in the emission direction, to be irradiated into the irradiated face either completely in front of or completely behind the focal point (F).

2. An LED lighting device as claimed in claim 1, wherein the reflector is curved in a two-dimensional manner and wherein the focal point comprises a focal line (F) in the irradiated face, and the collimated light is irradiated into the irradiated face either completely in front of or completely behind the focal line (F).

3. An LED lighting device as claimed in claim 1, wherein the collimator opening is arranged in the irradiated plane between the focal point (F) or the focal line and an edge of the irradiated plane.

4. An LED lighting device as claimed in claim 1, wherein the collimator opening is round.

5. An LED lighting device as claimed in claim 1, wherein the collimator opening is one selected from the group consisting of rectangular and square.

6. An LED lighting device as claimed in claim 1, wherein the LED element and collimator comprise an asymmetrical LED collimator element.

7. An LED lighting device as claimed in claim 1, wherein the LED element comprises a number of LED elements arranged next to one another and jointly irradiate via the collimator into the reflector, wherein the collimator comprises one or more collimators configured to collimate light from the LED elements and irradiate the collimated light in a substantially bundled manner at a corresponding collimator opening face.

8. An LED lighting device as claimed in claim 7, wherein the collimator comprises a plurality of collimators, each of which is assigned an LED element or a group of LED elements.

9. A headlamp system, in particular for motor vehicles, comprising a lighting device as claimed in claim 1.

10. An LED lighting device comprising:

an LED element configured to emit light at an emission angle $\theta_1$ with respect to a main emission direction;

a collimator including a truncated collimator element having a top face forming a base with a first cross-section, a bottom face forming a collimator opening with a second cross-section, wherein the second cross-section is larger than the first cross-section, and a lateral face disposed between the top face and the bottom face at an angle with respect to an axis of the collimator, the collimator configured to collimate the light emitted by the LED element and irradiate the collimated light through the collimator opening in a collimated manner, further at an emission angle $\theta_2$ smaller than $\theta_1$; and a reflector which has a semiparabolic concave reflective surface, (ii) an irradiated face, (iii) a focal point (F) in the irradiated face and (iv) an emission face from which light is emitted in an emission direction of the reflector during operation and which encloses an angle with the irradiated face, wherein the collimator is further configured to enable the collimated light coming from the collimator through the collimator opening, as seen in the emission direction, to be irradiated into the irradiated face either completely in front of or completely behind the focal point (F).

* * * * *